United States Patent [19]

Kruger et al.

[11] 3,981,765

[45] Sept. 21, 1976

[54] TREATMENT OF WOOD CHIPS WITH AN ALKALI METAL BOROHYDRIDE SOLUTION FOLLOWED BY MECHANICAL DEFIBRATION

[75] Inventors: Emilio Kruger, Milan; Guglielmo Ruffini, Lovere (Bergamo); Giovanni Gandini; Franco Ghislandi, both of Milan, all of Italy

[73] Assignee: Vita Mayer & C., Milan, Italy

[22] Filed: Dec. 17, 1974

[21] Appl. No.: 533,638

Related U.S. Application Data

[63] Continuation-in-part of Ser. No. 518,816, Oct. 29, 1974, abandoned, which is a continuation of Ser. No. 403,421, Oct. 4, 1973, abandoned, which is a continuation of Ser. No. 279,318, Aug. 10, 1972, abandoned, which is a continuation of Ser. No. 872,749, Oct. 30, 1969, abandoned.

[30] Foreign Application Priority Data

July 30, 1969 Italy ..... 20285/69
Sept. 26, 1969 Italy ..... 22550/69

[52] U.S. Cl. ..... 162/80; 162/86; 162/90

[51] Int. Cl.[2] ..... D21C 3/02; D21C 3/12

[58] Field of Search ..... 162/19, 25, 26, 28, 162/71, 80, 85, 86, 89, 84, 83, 82, 88, 87, 90

[56] References Cited

UNITED STATES PATENTS

| | | | |
|---|---|---|---|
| 2,069,943 | 2/1937 | Dreyfus | 162/86 X |
| 3,042,575 | 7/1962 | Hartler | 162/80 |
| 3,100,732 | 8/1963 | Smedberg | 162/80 X |
| 3,284,283 | 11/1966 | Kindron et al. | 162/25 |
| 3,637,516 | 1/1972 | Wade | 162/80 X |

*Primary Examiner*—S. Leon Bashore
*Assistant Examiner*—Arthur L. Corbin
*Attorney, Agent, or Firm*—Teare, Teare & Sammon

[57] ABSTRACT

A chemi-mechanical process for producing unbleached pulp with improved yields at high brightness including impregnating a lignocellulosic material in the form of wood chips with an alkaline solution containing an alkali metal borohydride in an amount over 0.1% by weight at a pH greater than 13, heating the impregnated chips at a temperature less than 150° C to provide semi-cooked chips having a brightness in excess of 60 GE, and then defiberizing the semi-cooked chips to mechanically separate the fibers into an unbleached pulp having said brightness and a yield of at least 85%.

5 Claims, No Drawings

TREATMENT OF WOOD CHIPS WITH AN ALKALI METAL BOROHYDRIDE SOLUTION FOLLOWED BY MECHANICAL DEFIBRATION

CROSS-REFERENCE TO RELATED APPLICATIONS

This is a continuation-in-part of Ser. No. 518,816 filed Oct. 29, 1974, now abandoned which is a continuation of application Ser. No. 403,421 filed Oct. 4, 1973, now abandoned, which was a continuation of application Ser. No. 279,318 filed Aug. 10, 1972, abandoned Oct. 9, 1973, which was a continuation of application Ser. No. 872,749 filed Oct. 30, 1969, and was abandoned on Nov. 12, 1972. A claim is made to priorities of Italian applications Ser. Nos. 20285A/69 and 22550A/69 filed July 30, 1969 and Sept. 26, 1969 respectively. Certified copies of Italian Patent applications, Ser. No. 20285A/69 filed July 30, 1969 and Ser. No. 22550A/69 filed Sept. 26, 1969, together with translations thereof, have been filed in application Ser. No. 279,318 and 403,421, pursuant to the provisions of 35 U.S.C. 119.

BACKGROUND OF THE INVENTION

The present invention relates to a method of producing high yield pulps at high brightness for papermaking, that having high requiring a relatively low cost plant, and also to a pulp having high yield with high unbleached brightness and good physical properties.

The increasing demand for paper and products based on cellulose requires a more complete wood utilization, and chiefly an increased hardwood use. Such utilization can be achieved with the high yield pulps with good mechanical properties and high brigthness of the present invention. Furthermore, highly costly plants meet financial difficulty and require high capacity of output to otain an economical production of pulps.

The need of big operation units for pulp production creates difficulty in the development of the paper industry in the underdeveloped countries and hinders the complete utilization of forest resources even in highly industrialized nations. The production of pulps with methods requiring relatively low cost plants is an important factor in the future development of the paper industry.

It is known that it is possible to obtain high yield pulps (85–95%) by treating wood chips (particularly hardwoods) with an aqueous solution of sodium hydroxide that has a cooking action on the wood more favorable than other chemicals. The wood swells rapidly when treated with caustic soda solution. The cross-linked structure of lignin limits the swelling of the whole fiber. Because the swelling differential creates stresses within the structure, much of the highly lignified outer layers are shed by the fiber when the treated wood is fiberized in a disk refiner. The exposed surface provides a good interfiber bonding.

The soda caustic solution saponifies the acetyl groups associated with the hemicelluloses and the esters and lactone groups that probably bond the hemicelluloses to the lignin; all of these facts increase the swelling of the cell walls and facilitate separation of fibers and interfiber bonding. Temperature higher than room temprature increases the rate of penetration of alkaline solution into the chips and speeds the above mentioned reactions of alkali on wood chips giving a pulp with improved properties.

The alkali treatment of the wood produces colored pulps, their colors varying from pale yellow to dark brown.

The difficult brightening of these high-lignin pulps increases the cost of plant and pulp production.

In the past, chemical processes have been used which employ an alkali metal borohydride in an effort to improve the brightness of a pulp. However, such prior processes have generally been carried out at relatively high temperatures in excess of 160° C for relatively long periods of time which affects the life and effectiveness of the borohydride for achieving maximum brightness, but which also dissolves a considerable quantity of the lignincellulosic material, therefore resulting in a lower yield (fibers vs. pulpwood). Such process is found, for example, in the U.S. Pat. No. 3,042,575 to Hartler.

Also, an alkali metal borohydride has been utilized in conjunction with a bisulfite ion for increasing the brightness of a pulp by formation of a bleaching agent, such as hydrosulfite, An example of such prior efforts may be found in the U.S. Pat. No. 3,284,283 to Kindron et al, issued Nov. 8, 1966. To maintain the stability of an alkali metal borohydride, such as sodium borohydride, an alkaline solution of high pH is desirable. The required high pH of this alkaline solution, however, converts the bisulfite to sulfite so that in order to produce a bisulfite to hydrosulfite conversion the stability of the borohydride must be sacrificed and the solution pH lowered. This results in a complex and difficult process which does not fully utilize the expensive borohydride component. Examples of other previous efforts may be found in the following patents:

| | | | |
|---|---|---|---|
| U.S. Pat. No. | 2,069,943 | Dreyfus | February 9, 1937 |
| | 2,996,422 | Durant | August 15, 1961 |
| | 3,186,899 | Madison | June 1, 1965 |
| | 3,100,732 | Smedberg | August 13, 1963 |

SUMMARY OF THE INVENTION

A primary object of the present invention is to provide a process for making a high yield (e.g., in excess of 85%) pulps at high brightness (e.g., in excess of 60% G.E.) by an efficient and relatively low cost installation, without bleaching the pulp, and to provide such high brightness and yield pulp with good color stability and high strength characteristics.

The invention contemplates a process that includes impregnation of lignincellulosic material in the form of wood chips with a alkaline solution containing an alkali metal borohydride in an amount not in excess of 2.0% by weight of the chips with the alkaline solution having a alkalinity not greater than 16% and with a pH greater than 13. Upon complete impregnation, the chips are heated for relatively short periods of time at a temperature not greater than 150° C and preferably at a temperature of 100° C for maximum reducing utilization of the borohydride to give a semi-cooked chip material having a brightness in excess of 60% G.E. and up to in excess of 80% G.E. The semi-cooked chips are then defiberized so as to mechanically separate the fibers of the chips into an unbleached pulp having such high brightness with a yield in excess of 85% and up to at least 90%. By this critical sequential process, there is provided a lower temperature, lower alkali quantity and shorter duration of heating so as to dissolve a substantially reduced quantity of lignincellulosic material to achieve such maximum yield (fibers vs. pulp wood) while at the same time imparting high brightness to the unbleached pulp with high strength characeristics (e.g., up to 8500 meters of breaking length at a Canadian Standard Freeness of 500 ) with good color stability.

By the present invention, there is provided a direct reducing action of the borohydride on the lignocellulosic chips which is enabled by the aqueous alkaline solution having a relatively low alkali quantity and temperature and, hence, a shorter cooking time. This process produces a semi-cooked pulp (as opposed to a chemical pulp) evidenced by intimately attached fibers with high brightness that must then be defiberized to complete mechanically the partial dissolving of the substances which bond the fibers together which cannot be directly achieved by conventional type refining methods, as provided in conventional type P.F.I. refiners which act upon chemically cooked pulps when the fibers are already individually separated, for example.

By the process of the present invention, it is possible to produce pulps with good properties from veneer wastes, agricultural residues and tropical wood without the need of further bleaching processes. The pulp produced may be employed as a substitute for ground wood, to replace in part the sulfite pulp from soft wood or the bleached pulp of hard wood, as a substitute for neutral sulfite, semi-chemical pulp or suitably mixed synthetic fiber, it may be used as a true chemical pulp. The pulp produced may be employed as a general ground wood and hard wood chemical pulp substitute or as a supplement in news print, printing and writing papers, toweling and tissues papers, food and other bleached boards. In mixture with small amounts of synthetic fibers, the pulp of the present invention may be employed as a substitute for bleached coniferous chemical pulps. In addition, the process of the present invention affords the possibility of using residues from saw mills and plywood mills which can be reduced to chips.

DESCRIPTION OF THE PREFERRED EMBODIMENTS

In one form, the present invention provides a chemimechanical process for the continuous making of an unbleached pulp with improved yield, brightness and mechanical characteristics for paper making purposes which includes the steps in sequence of providing a lignincellulosic material in the form of wood chips having a thickness in the range between 1/16 inch and ⅜ inch, impregnating the chips with alkaline solution comprised of an aqueous solution of sodium hydroxide and an alkali metal borohydride in an amount from 0.1 to 2.0% by weight of the chips, the alkaline solution having an alkalinity, based on the $Na_2O$ content of the alkaline material, not greater than 16% by weight and having a pH greater than 13, heating the alkaline borohydride-impregnated chips at a temperature of not greater than 150° for a time sufficient to provide semi-cooked chips having a brightness in excess of 60% G.E., and then defiberizing the semi-cooked chips to mechanically separate the fibers of the chips into an unbleached pulp having such high brightness with a yield in excess of 85%.

By this process, the wood chips are impregnated with a solution of sodium hydroxide containing borohydride with a relatiely low alkalinity, but at a pH in excess of 13. The caustic action operates to swell the chips to deacetylate the hemicelluloses to break the chemical bonds between the hemicelluloses and lignin contributing to confer good physical strength characteristics to the final pulp. Simultaneously with this action, the borohydride present in the alkaline solution is utilized to reduce carbonyl groups of the hemicelluloses or of the lignin and other chromophoric groups present in the lignincellulosic material. The reaction of the borohydride stops the peeling reaction on the polysaccharide chains caused by alkali to give a high brightness over 60 G.E. and up to in excess of 80 G.E. due to the reaction of the borohydride on the chromophoric groups of the lignocellulosic material.

The alkaline solution may be selected from the group consisting of an aqueous solution of sodium hydroxide or an aqueous solution of sodium hydroxide and sodium sulfite, or an aqueous solution of sodium sulfite and sodium carbonate, or an aqueous solution of buffered sodium sulfite.

It was found that the lignincellulosic material may be impregnated with said alkaline solution at room temperature and, after the drainage of the alkaline solution and before fiberizing, said drained material may be either cooked in vapor phase at a temperature within the range of from about 80°C to about 120° C, or in the presence of an aqueous solution of sodium sulfite, containing from about 5 g/l to about 20 g/l of sodium sulfite, at a preferred temperature of 110°C but not greater than 150°C for maximum reaction of the sodium borohydride.

In another form, the treatment of a lignincellulosic material, such as wood chips and particularly hardwood chips, by impregnation with an alkaline solution containing the alkali metal borohydride, such as sodium borohydride; separating the alkaline solution from the lignincellulosic material; adding an aqueous acid solution, such as an aqueous solution of sulfur dioxide, to adjust the pH of the solution containing the material to less than 13 pH; then heating the material at 110° C, but less than 150°C; and then defiberizing the material to produce the unbleached chips.

The lignincellulosic material used as the raw material for the method of the present invention should include both lignin and cellulose. It may comprise hardwood (deciduous) chips, softwood (coniferous) chips, or the like. The chip form is preferred to allow easy treatment of the lignincellulosic material with the various chemical agents used in the present invention. The thickness of the wood chips should be from 1/16 inch to ⅜ inch, while a thickness from 1/16 inch to ⅛ inch is preferred so as to give complete penetration of the lignincellulosic material as readily as possible (the term, complete penetration, as used herein refers to the penetration to the center of the wood chip by the particular chemical agent specified.

The lignincellulosic material, or wood chip material, may be impregnated with an alkaline solution containing an alkali metal borohydride so as to completely penetrate the wood chips. This alkaline impregnation with the alkali metal borohydride may be done at a temperature from room temperature to 50° C. The alkaline impregnation should be conducted rapidly, but for a sufficient length of time to permit complete penetration of the wood chips by the alkaline solution, such as at least 10 minutes. The alkaline impregnation may be conducted under various pressure conditions, such as ambient, reduced or elevated pressure, utilizing equipment known in the art. The ratio of the solution (or liquor) to wood (as expressed in milliliters to grams) may be in the range between 2 to 1 and 20 to 1 with the preferred ratio being 5 to 1. The dryness of the chips may be from 50 to 90%. Preferably, the lignincellulosic material is impregnated with the alkaline solution containing the alkali metal borohydride as rapidly as possible at a temperature as close to room temperature as possible to effect complete penetration. These conditions provide maximum utilization of the alkali metal borohydride.

The alkaline solution which contains the alkali metal borohydride may be an aqueous solution of sodium hydroxide, an aqueous solution of sodium hydroxide and sodium sulfite, or an aqueous solution of sodium sulfite and sodium carbonate. The desired pH of this alkaline solution should be at least 13. The alkalinity of the solution (which is expressed on the basis of the $Na_2O$ content of the alkaline material used) should be from 3.5% to not in excess of 16%, by weight, of $Na_2O$ to o.d. (oven dried) wood chips. An alkalinity of 8.0%, by weight, $Na_2O$ to o.d. wood chips is preferred.

The preferred alkali metal borohydride is sodium borohydride. It should be present in an amount equal to at least 0.1%, by weight, of the o.d. chips. A desirable amount would be in the range from 0.1 to 2.0%, by weight, while an amount from 0.2to 0.3%, by weight, is preferred.

At the conclusion of the alkaline impregnation with the alkali metal borohydride, the alkaline solution is preferably drained or separated from the wood chips for subsequent re-use. Preferably, at least 80% of the alkaline solution is drained from the impregnated chips.

In order to optimize utilization of the alkali metal borohydride impregnated into the lignincellulosic material in useful reduction reactions with the chromophoric radicals in the material's molecular structure, it is preferred that the alkaline borohydride-impregnated material be heated to a temperature from 80° C to 100° C for a period from 15 minutes to 30 minutes to accelerate the reaction of the sodium borohydride with the radicals after the alkaline impregnation at room temperature.

In one form, the pH of the solution containing the impregnated material may be adjusted to a value from 3 to 9 by adding an aqueous acid solution to the impregnated wood chips. Preferably, the pH is adjusted to a value from 4 to 7. This pH adjustment may be done with an aqueous acid solution containing an inorganic tetravalent sulfur compound, such as an aqueous solution containing sulfur dioxide (having a pH of approximately 2), or an aqueous solution containing sodium bisulphite (having a pH from 4 to 4.5). Such a solution may be formed by introducing gaseous sulfur dioxide into the solution containing the impregnated material.

In this form, at the conclusion of the pH adjustment, the lignincellulosic material is heated at a temperature not greater than 150° C. As aforesaid, after cooking, the lignincellulosic material is mechanically fiberized by a disc difibrator. In this case, the pulp is unbleached and semi-cooked because the preceding borohydride impregnation and heating steps are controlled to prevent dissolving of the substances which bond the chip fibers together to give a resultant yield (fiber vs. pulpwood) of 85% and up to in excess of 94%. Thus, in the invention, the fibers must then be separated by the mechanical fiberizing prior to any conventional type refining such as provided by a P.F.I. refiner.

Where an unbleached pulp having an unbleached brightness greater than 80% reflectance (Photovolt) is desired, it is preferred that the lignincellulosic material be initially treated by impregnation with an initial aqueous acid solution. The initial acid impregnation or pretreatment may be conducted at a temperature from room temperature to 50° C (room temperature being preferred). The elapsed pretreatment time should be of sufficient length to effect a complete penetration of the lignincellulosic material by the acid solution.

Such acid solution should have a pH from 2 to 5 and be selected from the group consisting of an aqueous acid solution of sodium bisulphite (having a pH from 4 to 4.5), an aqueous acid solution of sulfur dioxide (having a pH of approximately 2), or an aqueous acid solution of chlorine dioxide (having a pH of approximately 5). An aqueous acid solution of sulfur dioxide is the preferred solution. The amount of sodium bisulphite present in the aqueous acid solution of sodium bisulphite should be from 2 to 5%, by weight, of the lignincellulosic material (oven dried basis); the amount of sulfur dioxide present in the aqueous acid solution of sulfur dioxide should be from 1.2 to 3.1%, by weight, of the lignincellulosic material (oven dried) basis); and the amount of chlorine dioxide present in the aqueous acid solution of chlorine dioxide should be from 1 to 5%, by weight, of the lignincellulosic material (oven dried basis).

It is to be understood that while the foregoing is preferred to ensure an unbleached brightness greater than 80% reflectance (Photovolt), or 80.13 G.E., one can obtain an unbleached pulp with an unbleached brightness up to and including 80% reflectance (Photovolt) in accordance with the present invention without such pretreatment.

When an initial treatment of an aqueous acid solution of sodium bisulphite or sulphur dioxide is used, it is preferred that the acid-treated material be treated thereafter with an initial, or first, alkaline solution having a pH of at least 10 in a stoichiometric amount sufficient to react any residual bisulphite ions in the material into sulphite ions according to the following equation:

$$NaHSO_3 + NaOH \longrightarrow Na_2SO_3 + H_2O$$

After this preferred treatment with the initial alkaline solution having a pH of at least 10, the material may then be treated with the alkaline solution containing sodium borohydride in the manner and under the conditions previously stated. In this manner the sodium borohydride is utilized directly with the lignincellulosic material rather than reacting with residual bisulphite to form hydrosulphite.

In an alternative form, the alkaline solution containing the sodium borohydride can be used alone without an initial alkaline solution. In this instance, it is believed that the alkalinity of the alkaline solution in excess of 13 pH is sufficient to react the bisulphite ions into sulphite ions before the bisulphite ions can react with the alkali metal borohydride to create hydrosulphite.

Where the lignincellulosic material is pretreated with chlorine dioxide, the acid impregnated material should be washed with water and then impregnated with the alkaline solution containing sodium borohydride in the manner and under the conditions previously stated. Where an initial pretreatment with an acid solution is used, the steps which follow the pretreatment should proceed in the manner and under the conditions previously stated.

Among the various advantages offered by the present method of making pulp, the first of all is the possibility to obtain a high yield pulp with good physical properties and high brightness without the need of further bleaching process.

The use of sodium borohydride has a twofold effect: it pevents color formation and by reducing the terminal aldehyde groups of the polysaccharides by the following reaction:

$$4\ RCHO + NaBH_4 + 2NaOH + H_2O \longrightarrow 4\ RCH_2OH + Na_3BO_3$$

it increases the pulp yields 10 to 20% by blocking the peeling reaction which occurs in an alkaline medium.

The present invention includes as a new article of manufacture an unbleached pulp having the properties of high hield and high unbleached brightness together with good color stability and high strength. In accordance with the methods of the present invention, an unbleached pulp having a yield of at least 85%, an unbleached brightness of at least 70% reflectance (Photovolt) 65 GE as determined by TAPPI Standard T-217, a color reversion of less than six units on a percent reflectance (Photovolt) basis (using TAPPI Standard T-217 and after aging a specimen of the pulp at 105°C for 24 hours without added moisture), a breaking length of at least 5000 meters as determined by TAPPI Standard T-220, a tear factor of at least 30, and a burst factor of at least 23 is produced. An unbleached hardwood pulp produced in accordance with the preferred method of the present invention (wherein the lignincellulosic material is initially treated with an acid solution prior to impregnation of the alkaline solution containing sodium borohydride) should have the following characteristics:

| | |
|---|---|
| Yield | 85–92% |
| Brightness | 80–90% reflectance (Photovolt)/ (80–93GE |
| Color Reversion | 3–5 units on a reflectance (Photovolt)basis |
| Breaking Length | 6000 meters to 8000 meters |
| Tear Factor | 40–50 |
| Burst Factor | 30–35 |
| Color | Blue-White |

Accordingly, the method of the present invention is capable of producing an unbleached pulp having, as follows:

a yield of at least 90% an unbleached brightness of at least 90% reflectance (photovolt) or 13% GE a breaking length of at least 6000 meters, and a maximum color reversion of 6 percentage units.

The following examples more particularly set forth certain features of the present invention.

EXAMPLE 1

100 g. of poplar wood chips (thickness aout 1mm.) were treated with 500 ml of an alkaline liquor containing 20 g/l of sodium hydroxide and 2 g/l of sodium borohydride at 110°C over a period of 30 minutes and having a calculated pH of about 13.7. Wood and liquor were separated and the impregnated chips were fiberized in a laboratory disk refiner. The pulp was neutralized to pH 7 with an aqueous solution of sulfur dioxide having a pH of approximately 2, and then screened. The amount of sodium hydroxide and of sodium borohydride taken up from the solution was respectively 5% and 0.3–5% on o.d. (oven dried), wood basis.

The yield of such a pulp was 95%, the brightness 80 (Photovolt) or 80% G.E., and a varying freeness (depending on the degree of defibration) of 680 to 500 C.S.F. (Canadian Standard Freeness).

Handsheets of paper obtained from a pulp having a freeness of 590 C.S.F. exhibited a breaking length of 6,700 m., a bursting factor of 28 and a tear factor of 40.

The chips of ailanthus wood and birch wood, cooked under the same conditions, had, respectively, the following characteristics:

| | |
|---|---|
| Ailanthus: | Brightness 78% (reflectance Photovolt) or 75% G.E. breaking length 2,500 meters, tear factor 30; |
| Birch: | Brightness 74, or 73% GE, breaking length 6000 meters, tear factor 60. |

EXAMPLE 2

100 g. of poplar wood chips were cooked at 110° C over a period of 60 minutes with an alkaline liquor containing 10 g/l of sodium hydroxide, 10 g/l of sodium sulphite and 0.6 g/l of sodium borohydride and having a calculated pH of about 13.4. The wood/liquor ratio was 1/5.

The same procedure as in example was then followed. Handsheets from the pulp produced according to this example exhibited a breaking length of 5,100 m, a burst factor of 23, a tear factor of 32, a brightness of 70 (Ph). or 64% GE.

EXAMPLE 3

100 g. of poplar veneer wastes chips were treated at 80°C over a period of 1 hour with an aqueous solution containing 20 g/1 of sodium hydroxide and 2 g/l of sodium borohydride and having a calculated pH of about 13.7. The same procedure as in example 1 was then followed. The sodium borohydride taken up from the solution was 0.4% (o.d. wood basis).

Handsheets made from this pulp exhibited a brightness of 75 (Ph.) or 73% GE, a breaking length of 6,700 m., a tear factor of 47, a burst factor of 30.

EXAMPLE 4

100 g. of poplar chips with a thickness of 0.5 – 1mm were impregnated at room temperature with 1000 ml of an alkaline liquor containing 20 g/l of sodium hydroxide and 2 g/1 of sodium borohydride and having a calculated pH of about 13.7, over a period of 2 hours. 80% of the liquor was separated and the impregnated chips were cooked in vapor phase at 110° C for 30 minutes. The pulp obtained after fiberizing was acidified with an aqueous solution of sulfur dioxide.

The sodium borohydride consumed was 0.4% (o.d. wood basis). The pulp yield was 92.8%.

Handsheets from the pulp produced according to this example exhibited a brightness of 65 (Ph.) or 60% GE., a breaking length of 5,600 m., a tear factor of 35 and a burst factor of 22.

EXAMPLE 5

100 g. of poplar chips were cooked at 110°C over a period of 90 minutes with a liquor containing 10 g/l of sodium bisulphite and having a pH of approximately 4.2. Wood and liquor were separated and the treated chips were then cooked with an alkaline liquor contaning 30 g/l of sodium hydroxide and 2 g/l of sodium borohydride, and having a calculated pH of about 13.9, at 110°C for 30 minutes.

Handsheets from the pulp produced according to this example exhibited a yield of 91% a breaking length of 8,600 m., a burst factor of 32, a tear factor of 36 and brightness of 78 Ph., or 75% G.E.

EXAMPLE 6

100 g. of tropical wood, locally named Koto, were treated according to the procedure outlined in Example 1.

The pulp yield was 93%. Handsheets of 60 g/m² of basis weight exhibited a breaking length of 6,600 m., a burst factor of 24, a tear factor of 33 and a brightness of 75, or 73% G.E.

EXAMPLE 7

100 g. of poplar chips were completely impregnated at room temperature in an alkaline liquor containing 40 g/l of sodium hydroxide and 2 g/l of sodium borohydride and having a calculated pH of about 14; 80% of the alkaline solution was drained and 200 ml of an aqueous solution containing 25 g/l of sulfur dioxide, and having a pH of approximately 2, was added to the impregnated chips, to produce a pH of approximately 4.2 before cooking. The wood and liquor mixture was then cooked at 120° C for 90 minutes to give a final pH between 6.5 and 7 and successively fiberized.

The pulp yield was 95%, the total sodium borohydride consumption was 0.3% (o.d. wood basis). Handsheets made from Such a pulp at 530 ml C.S.F. exhibited a brightness of 78 Ph., or 75% G.E., a breaking length of 8,500 m., a burst factor of 34 and a tear factor of 37.

EXAMPLE 8

100 grams of poplar chips were completely impregnated using 500 ml. of an aqueous alkaline solution containing 10.5 g/l of sodium hydroxide and 0.425 of sodium borohydride and having a pH of about 13.2. Then an aqueous solution of sodium bisulphite was added to the alkaline solution to adjust the pH of the liquid to 6. The chips were cooked for 90 minutes at a temperature of 150° C and were then mechanically fiberized to yield a pulp with the following characeristics:

| | |
|---|---|
| Unbleached brightness | 85.5% reflectance (Photovolt) 87.4 GE |
| Yield | 91.0% |
| Breaking length | 7400m. |
| Tear factor | 51 |
| Freeness | 450 ml. (C.S.F.) |

EXAMPLE 9

100 grams of poplar chips were impregnated at room temperature under a pressure of 7 kg/cm.² for 30 minutes using 500 ml. of an aqueous solution containing 15 g/l of sodium hydroxide and 0.63 g/l of sodium borohydride and having a pH of about 13.5. The liquor and the chips were heated at 50 C. for one hour. An aqueous solution of sulphur dioxide was added to the alkaline solution to adjust the pH to 4.2 and then pulping was done at 130°C for two hours. After disc refining, a pulp was produced with a yield of 93% and an unbleached brightness of 84.8 reflectance (Photovolt) or 86.5 GE.

The properties of the high yield pulps obtained following the present invention are compared with those ones of high yield pulps made by commercial methods, in Tables 1 and 2.

TABLE 1

| KIND OF PULP | YIELD | FREENESS | BREAKING LENGTH |
|---|---|---|---|
| | | C.S.F. | |
| BLEACHED POPLAR | 90 | 143 | 1700 |
| GROUNDWOOD BLEACHED SPRUCE | 90 | 165 | 3300 |
| GROUNDWOOD HOT-SULPHITE | 92 | 180 | 3000 |
| CHEMIMECHANICAL NEW HIGH YIELD PULP | | | |
| EXAMPLE 1 | 94 | 590 | 6700 |
| EXAMPLE 3 | 95 | 640 | 6700 |
| EXAMPLE 7 | 94 | 530 | 8500 |

TABLE 2

| KIND OF PULP | BURST | TEAR | BRIGHT-NESS | $NaBH_4$ consumed % o.d. wood |
|---|---|---|---|---|
| BLEACHED POPLAR | 6 | 22 | 70 | — |
| GROUNDWOOD BLEACHED SPRUCE | 14 | 49 | 61 | — |
| GROUNDWOOD HOT-SULPHITE | 12 | 33 | 51 | — |
| CHEMIMECHANICAL NEW HIGH YIELD PULP | | | | |
| EXAMPLE 1 | 28 | 40 | 80 | 0.3–0.5 |
| EXAMPLE 3 | 30 | 47 | 75 | 0.4 |
| EXAMPLE 7 | 34 | 37 | 78 | 0.3 |

It is evident from the data shown in Tables 1 and 2 that the properties of the pulps produced following the present invention are better than those ones produced by known methods. From the table it is clear that the pulp produced by the process of the present invention has characteristics superior to the others both as to mechanical strength and as to the degree of brightness. The pulp produced by the process described in this invention is somewhat similar, as to physical characteristics, to a neutral sulfite pulp, but, based on its high yield, is somewhat similar to a chemical-mechanical pulp. The degree of brightness shown in Table 2 is in every case sharply superior. The addition of a certain amount of synthetic fiber, as for example 5% nylon, can increase the resistance to tearing by 100% and the breaking length by 20%. It was found that the treatment with said aqueous acid solution may be done with a solution of sodium bisulfite containing between about 5 g/l and 20 g/l of sodium bisulfite at a temperature within the range of from about 110° C to about 150° C before treating said material with said alkaline solution.

For convenience, the correlation between G.E. brightness, as set forth in the affidavit filed in parent application Ser. No. 872,749, is as follows: Brightness (G.E.) equals 1.321 times the brightness (Photovolt) less the value of 25.551

We claim:

1. A chemi-mechanical process for making an unbleached pulp with yield of at least 85% and brightness in excess of 60 G.E. with good color stability and high strength characteristics for papermaking purposes, the steps comprising in sequence:

a. providing a lignocellulosic material in the form of wood chips having a thickness in the range between 1/16 and ⅛ inch, and a dryness between 50 to 90%, b. impregnating the chips at a temperature from room temperature to 50°C with an alkaline solution comprised of an aqueous solution of sodium hydroxide and an alkali metal borohydride in an amount from 0.1 to 2.0% by weight of the chips and with a ratio of solution to chips of 2:1 to 20:1, said alkaline solution having an alkalinity, based on the $Na_2O$ content of the alkaline material, from 3.5% to not in excess of 16%, by weight, and having a pH in excess of 13, c. heating the alkaline borohydride-impregenated chips at a temperature not greater than 150°C for at time between 15 minutes to 30 minutes to provide semi-cooked chips, d. separating said semi-cooked chips from the solution, and e. defiberizing the separated semi-cooked chips to mechanically separate the fibers of the chips into an unbleached pulp having said brightness, yield, and strength characteristics.

2. A process according to claim 1 , wherein the impregnation is carried out for a time of at least 10 minutes at room temperature.

3. A process according to claim 1, wherein the chips are impregnated with an aqueous acid solution prior to said impregnating to give a brightness of at least 80% GE.

4. A process according to claim 3, wherein said aqueous acid solution comprises a solution selected from the group consisting of an aqueous solution of sulfur dioxide and an aqueous solution of sodium bisulphite.

5. A process according to claim 3, wherein the acid solution has a pH from 2 to 5.

* * * * *